US006379780B1

(12) United States Patent
Laney et al.

(10) Patent No.: US 6,379,780 B1
(45) Date of Patent: Apr. 30, 2002

(54) PERMEABLE SURFACE IMAGING SUPPORT

(75) Inventors: Thomas M. Laney, Hilton; Eric E. Arrington, Canandaigua; Jehuda Greener, Rochester, all of NY (US); Julie A. Sampson, Vernon, CT (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/472,487

(22) Filed: Dec. 27, 1999

(51) Int. Cl.[7] ..... B41M 5/00

(52) U.S. Cl. ..... 428/195; 428/212; 428/304.4; 428/480

(58) Field of Search ..... 428/195, 207, 428/212, 480, 304.4, 318.4, 327

(56) References Cited

U.S. PATENT DOCUMENTS

| | | | | |
|---|---|---|---|---|
| 3,944,699 | A | 3/1976 | Mathews et al. | 428/220 |
| 4,340,639 | A | 7/1982 | Toyoda et al. | 428/338 |
| 4,350,655 | A | 9/1982 | Hoge | 264/145 |
| 4,377,616 | A | 3/1983 | Ashcraft et al. | 428/213 |
| 4,472,227 | A | 9/1984 | Toyoda et al. | 156/244.11 |
| 4,483,965 | A | 11/1984 | Ohba et al. | 525/322 |
| 4,496,620 | A | 1/1985 | Park et al. | 428/323 |
| 4,582,752 | A | 4/1986 | Duncan | 428/317.9 |
| 4,632,869 | A | 12/1986 | Park et al. | 428/315.5 |
| 4,681,803 | A | 7/1987 | Liu | 428/348 |
| 4,698,372 | A | 10/1987 | Moss | 521/145 |
| 4,699,744 | A | 10/1987 | Nakadate et al. | 264/101 |
| 4,701,369 | A | 10/1987 | Duncan | 428/313.9 |
| 4,701,370 | A | 10/1987 | Park | 428/314.4 |
| 4,702,954 | A | 10/1987 | Duncan | 428/213 |
| 4,704,323 | A | 11/1987 | Duncan et al. | 428/286 |
| 4,758,462 | A | 7/1988 | Park et al. | 428/213 |
| 4,770,931 | A | 9/1988 | Pollock et al. | 428/304.4 |
| 4,780,364 | A | 10/1988 | Wade et al. | 428/315.5 |
| 4,780,402 | A | 10/1988 | Remmington | 430/533 |
| 4,814,124 | A | 3/1989 | Aoyama et al. | 264/41 |
| 4,871,784 | A | 10/1989 | Otonari et al. | 521/138 |
| 4,877,679 | A | 10/1989 | Leatherman et al. | 428/224 |
| 4,879,078 | A | 11/1989 | Antoon, Jr. | 264/41 |
| 4,960,637 | A | 10/1990 | Biczeaczuk | 428/314.4 |
| 4,983,447 | A | 1/1991 | Crass et al. | 428/216 |
| 5,028,480 | A | 7/1991 | Dean | 428/314.4 |
| 5,084,334 | A | 1/1992 | Hamano et al. | 428/304.4 |
| 5,141,685 | A | 8/1992 | Maier et al. | 264/45.3 |
| 5,143,765 | A | 9/1992 | Maier et al. | 428/36.5 |
| 5,178,943 | A | 1/1993 | Asai et al. | 428/330 |
| 5,223,383 | A | 6/1993 | Maier et al. | 430/533 |
| 5,275,854 | A | 1/1994 | Maier et al. | 428/36.5 |
| 5,326,391 | A | 7/1994 | Anderson et al. | 106/409 |
| 5,422,175 | A | 6/1995 | Ito et al. | 428/304.4 |
| 5,605,750 | A | 2/1997 | Romano et al. | 428/304.4 |

FOREIGN PATENT DOCUMENTS

| | | |
|---|---|---|
| EP | 0 322 771 A2 | 7/1989 |
| EP | 0 672 536 | 9/1995 |
| EP | 0 756 941 | 2/1997 |
| WO | WO 89/08023 | 9/1989 |
| WO | WO 98/32541 | 7/1998 |

OTHER PUBLICATIONS

WPI Abstract Acc. No. 88–225065 & JP 94089160 B2.
WPI Abstract Acc. No. 88–318765 & JP 96005978 B2.

*Primary Examiner*—Bruce H. Hess
(74) *Attorney, Agent, or Firm*—Paul A. Leipold

(57) ABSTRACT

The invention relates to an imaging support comprising an impermeable bottom layer wherein said bottom layer comprises polyester and a permeable upper layer said upper layer comprising polyester having a dry time of less than 10 seconds.

24 Claims, No Drawings

PERMEABLE SURFACE IMAGING SUPPORT

FIELD OF THE INVENTION

The present invention relates generally to an opaque image-recording element and, more particularly, the present invention relates to a recording element for an automated printing assembly such as a computer-driven ink-jet printer having excellent ink-receiving properties.

BACKGROUND OF THE INVENTION

In a typical ink-jet recording or printing system, ink droplets are ejected from a nozzle at high speed towards a recording element or medium to produce an image on the medium. The ink droplets, or recording liquid, generally comprise a recording agent, such as a dye, and a large amount of solvent in order to prevent clogging of the nozzle. The solvent, or carrier liquid, typically is made up of water, an organic material such as a monohydric alcohol or a polyhydric alcohol or a mixed solvent of water and other water miscible solvents such as a monohydric alcohol or a polyhydric alcohol.

The recording elements or media typically comprise a substrate or a support material having on at least one surface thereof an ink-receiving or image-forming layer. The elements include those intended for reflection viewing, which usually have an opaque support, and those intended for viewing by transmitted light, which usually have a transparent support.

While a wide variety of different types of image-recording elements have been proposed heretofore, there are many unsolved problems in the art and many deficiencies in the known products which have severely limited their commercial usefulness. The requirements for an image-recording medium or element for ink-jet recording are very demanding. For example, the recording element must be capable of absorbing or receiving large amounts of ink applied to the image-forming surface of the element as rapidly as possible in order to produce recorded images having high optical density and good color gamut.

One example of an opaque image-recording element is described in U.S. Pat. No. 5,326,391. It consists of a layer of a microporous material which comprises a matrix consisting essentially of a substantially water-insoluble thermoplastic organic polymer, such as a linear ultra-high molecular weight polyethylene, a large proportion of finely divided water-insoluble filler of which at least about 50 percent by weight is siliceous and interconnecting pores. The porous nature of the image-recording element disclosed in U.S. Pat. No. 5,326,391 allows inks to penetrate the surface of the element to produce text and/or graphic images. However, the cost of producing these elements is relatively high. Also, the image density has been found to be of poor quality, i.e., the images have low optical densities and poor color gamut. U.S. Pat. No. 5,605,750 has already addressed the latter shortcomings of image density and color gamut via the application of an upper image-forming layer. This upper image forming layer is a porous, pseudo-boehmite having average pore radius of from 10 to 80 Å. However, the high manufacturing cost of the article to form the absorbent layer is not solved in U.S. Pat. No. 5,605,750. This is due to the requirements for the porous substrate as described in U.S. Pat. No. 5,326,391. Thus, it can be seen that a need still exists in the art for the provision of an opaque image-recording element suitable for use in an ink-jet printer, which is capable of recording images (including color images) having fast dry times, high optical densities and good color gamut, but which is capable of being manufactured at a relatively low manufacturing cost. It is towards fulfilling this need that the present invention is directed.

PROBLEM TO BE SOLVED BY THE INVENTION

There remains a need for an image-receiving member that has rapid absorption of ink and relatively low cost.

SUMMARY OF THE INVENTION

It is an object of the invention to overcome disadvantages of prior imaging supports.

It is another object of the invention to produce imaging supports that have short dry time for inks.

It is a further object of the invention to provide imaging supports that are dimensionally stable and low in cost.

These and other objects of the invention are accomplished by an imaging support comprising a base polyester layer and an ink permeable upper layer, said upper layer comprising of a continuous polyester phase having an ink absorbency rate resulting in a dry time of less than 10 seconds and a total absorbent capacity of at least 14.0 $cm^3/m^2$.

ADVANTAGEOUS EFFECT OF THE INVENTION

It is an object of the invention to provide an imaging member that has a high absorptive capacity for ink and is relatively low in cost.

DETAILED DESCRIPTION OF THE INVENTION

The invention has numerous advantages over prior practices in the art. The imaging members of the invention may be made on readily available polyester film formation machines. The members of the invention preferably are made in one step with the permeable layer and the bottom base layer being coextruded, stretched, and integrally connected during formation. The imaging members are low in cost as the one step formation process leads to low manufacturing cost. The imaging members of the invention have rapid absorption of ink, as well as high absorbent capacity, which allows rapid printing and short dry time. Short dry time is advantageous, as the prints are less likely to smudge and have higher image quality as the inks do not coalesce prior to drying. The imaging members of the invention have the look and feel of paper, which is desirable to the consumer. The imaging members of the invention have a desirable surface look without pearlescence and present a smooth desirable image. The imaging member of the invention further is weather resistant and resistant to curling under differing humidity conditions. The imaging members of the invention further have high resistance to tearing and deformation. These and other advantages will be apparent from the detailed description below.

The term as used herein, "top", means the side or toward the side of the permeable polyester layer. The terms "bottom" and "base" mean the side or toward the side of the base polyester.

The layers of the coextruded polyester sheet of this invention have levels of voiding, thickness, and smoothness adjusted to provide optimum ink absorbency, stiffness, and gloss properties. The polyester sheet has a voided layer to efficiently absorb the printed inks commonly applied to ink-jet imaging supports without the need of multiple processing steps and multiple coated layers. The coextruded polyester base of the invention contains a polyester layer to provide stiffness to the imaging support of the invention and to provide physical integrity to the highly voided absorbing layer. The thickness of the base layer is chosen to cause the total imaging support thickness to be 50 to 500 $\mu$m depending on the required stiffness of the film. However, the thickness of the top layer is adjusted to the total absorbent capacity of the medium. A thickness of at least 28.0 $\mu$m is needed to achieve a total absorbency of 14 $cm^3/m^2$. The rate at which inks are absorbed into the permeable layer is critical as discussed hereinbefore. The voiding should be such that the voids are interconnected or open-celled. This type of structure enhances ink absorption rate by enabling capillary action to occur. The sheet of the described invention has a permeable layer with an absorbing rate resulting in a dry time of less than 10 seconds.

Dry time is measured by printing a color line on the side of the top layer with an ink-jet printer at a laydown of approximately 15 $cm^3/m^2$ utilizing inks of the following formulation:

| Ink | Water | 2-Pyrro-lidone | Diethylene Glycol | 1,5 Pentadiol | EHMP | Dyes |
|---|---|---|---|---|---|---|
| Cyan | 76% | 6% | ND | 8.6% | 7.7% | 1.7% |
| Magenta | 75% | 7.8% | ND | 8.5% | 7.5% | 1.2% |
| Yellow | 81% | 4.2% | 4.3% | ND | 8.2% | 1.3% |

Where: EHMP=2-ethyl-2-(hydroxymethyl)-1,3-propanediol

This was accomplished utilizing an HP 722 ink-jet printer using standard HP dye-based ink cartridge (HP #C1823A) with the printed lines running in the direction of the sheet as it is conveyed through the printer. Dry time is measured by superposing a fresh printing paper on top of the printed line pattern immediately after printing and pressing the papers together with a roller press. If a particular printed line transfers to the surface of the fresh paper, its transferred length L could be used for estimating the dry time $t_D$ using a known linear transport speed S for the printer based on the formula $$t_D = \frac{L}{S}$$

In a preferred embodiment of the invention, the ink absorbency rate results in a measured dry time of less than 1 second. The thickness of the voided layer should be such as to enable at least 14.0 $cm^3$ of ink to be absorbed per 1 $m^2$. The actual thickness can be determined by using the formula t=14.0/v where v is the void volume fraction defined as the ratio of voided thickness minus unvoided thickness to the voided thickness. The unvoided thickness is defined as the thickness that would be expected had no voiding occurred.

The polyester utilized in the top layer should have a glass transition temperature between about 50° C. and 150° C. preferably 60–100° C., should be stretchable, and have an inherent viscosity of at least 0.50, preferably 0.6 to 0.9 dl/g. Suitable polyesters include those produced from aromatic, aliphatic, or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumartc, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclohexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

The base layer is substantially impermeable. In its preferred embodiment this base layer is comprised of poly (ethylene terephthalate) and its copolymers, which are lowest in cost and readily available.

Suitable particles for the microbeads used for void generation in the permeable layer during sheet formation are either commercially available inorganic fillers or polymerizable organic materials. The size of the microbeads is preferably in the range of 0.01 to 10 $\mu$. Typical inorganic materials are silica, alumina, calcium carbonate, and barium sulfate. Typical polymeric organic materials are polystyrenes, polyamides, fluoro polymers, polycarbonates, or polyolefins.

Preferred polymers are cross-linked and are selected from the group consisting of an alkenyl aromatic compound having the general formula

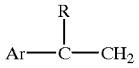

wherein Ar represents an aromatic hydrocarbon moiety, or an aromatic halohydrocarbon moiety of the benzene series and R is hydrogen or methyl moiety; acrylate-type monomers including monomers of the formula

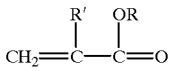

wherein R is selected from the group consisting of hydrogen and an alkyl moiety containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having the

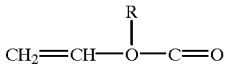

wherein R is an alkyl group containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, oiallyl fumarate, diallyl phthalate, and mixtures thereof.

Examples of typical monomers for making the cross-linked polymer microbeads include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, etc. Preferably, the cross-linked polymer is polystyrene or poly(methyl methacrylate). Most preferably, it is polystyrene, and the cross-linking agent is divinylbenzene.

Processes well known in the art yield nonuniformly sized particles, characterized by broad particle size distributions. The resulting beads can be classified by screening to produce beads spanning the range of the original distribution of sizes. Other processes such as suspension polymerization and limited coalescence directly yield very uniformly sized particles. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescence" technique for producing the coated, cross-linked polymer microbeads. This process is described in detail in U.S. Pat. No. 3,615,972. Preparation of the coated microbeads for use in the present invention does not utilize a blowing agent as described in this patent, however.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid and, hence, the diameter of the beads of polymer, can be varied predictably, by deliberate variation of the composition of the aqueous liquid dispersion, within the range of from about one-half of a $\mu$m or less to about 0.5 centimeter. For any specific operation, the range of diameters of the droplets of liquid and, hence, of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation are not highly critical. Furthermore, by employing the same composition, the operations can be repeated, or the scale of operations can be changed, and substantially the same results can be obtained.

The present bead-formation method is carried out by dispersing one part by volume of a polymerizable liquid into at least 0.5, preferably from 0.5 to about 10 or more, parts by volume of a nonsolvent aqueous medium comprising water and at least the first of the following ingredients:

1. A water-dispersible, water-insoluble solid colloid, the particles of which, in aqueous dispersion, have dimensions in the order of from about 0.008 to about 50 vm, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, surface-active agents and the like; and usually,
5. A water-soluble, monomer-insoluble inhibitor of polymerization.

The water-dispersible, water-insoluble solid colloids can be inorganic materials such as metal salts or hydroxides or clays, or can be organic materials such as raw starches, sulfonated cross-linked organic high polymers, resinous polymers, and the like.

The solid colloidal material must be insoluble but dispersible in water and both insoluble and nondispersible in, but wettable by, the polymerizable liquid. The solid colloids must be much more hydrophilic than oleophilic so as to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size is approximately that of the swollen particle. The particles can be essentially single molecules, as in the case of extremely high molecular weight cross-linked resins, or can be aggregates of many molecules. Materials that disperse in water to form true or colloidal solutions in which the particles have a size below the range stated or in which the particles are so diffuse as to lack a discernible shape and dimension are not suitable as stabilizers for limited coalescence. The amount of solid colloid that is employed is usually such as corresponds to from about 0.01 to about 10 or more grams per 100 cubic centimeters of the polymerizable liquid.

In order to function as a stabilizer for the limited coalescence of the polymerizable liquid droplets, it is essential that the solid colloid must tend to collect with the aqueous liquid at the liquid-liquid interface, i.e., on the surface of the oil droplets. (The term "oil" is occasionally used herein as generic to liquids that are insoluble in water.) In many instances, it is desirable to add a "promoter" material to the aqueous composition to drive the particles of the solid colloid to the liquid-liquid interface. This phenomenon is well known in the emulsion art, and is here applied to solid colloidal particles, as an expanded of adjusting the "hydrophilic-hydrophobic balance."

Usually, the promoters are organic materials that have an affinity for the solid colloid and also for the oil droplets and that are capable of making the solid colloid more oleophilic. The affinity for the oil surface is usually due to some organic portion of the promoter molecule, while affinity for the solid colloid is usually due to opposite electrical charges. For example, positively charged complex metal salts or hydroxides, such as aluminum hydroxide, can be promoted by the presence of negatively charged organic promoters such as water-soluble sulfonated polystyrenes, alignates, and carboxymethylcellulose. Negatively charged colloids, such as Bentonite, are promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials such as proteinaceous materials like gelatin, glue, casein, albumin, glutin, and the like are effective promoters for a wide variety of colloidal solids. Nonionic materials like methoxycellulose are also effective in some instances. Usually, the promoter need be used only to the extent of a few parts per million of aqueous medium, although larger proportions can often be tolerated. In some instances, ionic materials normally classed as emulsifiers, such as soaps, long chain sulfates and sulfonates and the long chain quaternary ammonium compounds, can also be used as promoters for the solid colloids, but care must be taken to avoid causing the formation of stable colloidal emulsions of the polymerizable liquid and the aqueous liquid medium.

An effect similar to that of organic promoters is often obtained with small amounts of electrolytes, e.g., water-soluble, ionizable alkalies, acids and salts, particularly those having polyvalent ions. These are especially useful when the excessive hydrophilic or insufficient oleophilic characteristic of the colloid is attributable to excessive hydration of the colloid structure. For example, a suitably cross-linked sulfonated polymer of styrene is tremendously swollen and hydrated in water. Although the molecular structure contains benzene rings which should confer on the colloid some affinity for the oil phase in the dispersion, the great degree of hydration causes the colloidal particles to be enveloped in a cloud of associated water. The addition of a soluble, ionizable polyvalent cationic compound, such as an aluminum or calcium salt, to the aqueous composition causes extensive shrinking of the swollen colloid with exudation of a part of the associated water and exposure of the organic portion of the colloid particle, thereby making the colloid more oleophilic.

The solid colloidal particles whose hydrophilic-hydrophobic balance is such that the particles tend to gather in the aqueous phase at the oil-water interface, gather on the surface of the oil droplets, and function as protective agents during limited coalescence.

Other agents that can be employed in an already known manner to effect modification of the colloidal properties of the aqueous composition are those materials known in the art as peptizing agents, flocculating and deflocculating agents, sensitizers, surface active agents, and the like.

It is sometimes desirable to add to the aqueous liquid a few parts per million of a water-soluble, oil-insoluble inhibitor of polymerization effective to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid is then admixed with the liquid polymerizable material in such a way as to disperse the liquid polymerizable material as small droplets within the aqueous medium. This dispersion can be accomplished by any usual means, e.g., by mechanical stirrers or shakers, by pumping through jets, by impingement, or by other procedures causing subdivision of the polymerizable material into droplets in a continuous aqueous medium.

The degree of dispersion, e.g., by agitation, is not critical except that the size of the dispersed liquid droplets must be no larger, and is preferably much smaller, than the stable droplet size expected and desired in the stable dispersion. When such condition has been attained, the resulting dispersion is allowed to rest with only mild, gentle movement, if any, and preferably without agitation. Under such quiescent conditions, the dispersed liquid phase undergoes a limited degree of coalescence.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which can be as large as 0.3 and sometimes 0.5 centimeter in diameter, are quite stable as regards further coalescence and are remarkably uniform in size. If such a large droplet dispersion be vigorously agitated, the droplets are fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying this phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, i.e., on the surface of the oil droplets. It is thought that droplets which are substantially covered by such solid colloid are stable to coalescence while droplets which are not so covered are not stable. In a given dispersion of a polymerizable liquid the total surface area of the droplets is a function of the total volume of the liquid and the diameter of the droplets. Similarly, the total surface area barely coverable by the solid colloid, e.g., in a layer one particle thick, is a function of the amount of the colloid and the dimensions of the particles thereof. In the dispersion as initially prepared, e.g., by agitation, the total surface area of the polymerizable liquid droplets is greater than can be covered by the solid colloid. Under quiescent conditions, the unstable droplets begin to coalesce. The coalescence results in a decrease in the number of oil droplets and a decrease in the total surface area thereof up to a point at which the amount of colloidal solid is barely sufficient substantially to cover the total surface of the oil droplets, whereupon coalescence substantially ceases.

If the solid colloidal particles do not have nearly identical dimensions, the average effective dimension can be estimated by statistical methods. For example, the average effective diameter of spherical particles can be computed as the square root of the average of the squares of the actual diameters of the particles in a representative sample.

It is usually beneficial to treat the uniform droplet suspension prepared as described above to render the suspension stable against congregation of the oil droplets.

This further stabilization is accomplished by gently admixing with the uniform droplet dispersion an agent capable of greatly increasing the viscosity of the aqueous liquid. For this purpose, there may be used any water-soluble or water-dispersible thickening agent that is insoluble in the oil droplets and that does not remove the layer of solid colloidal particles covering the surface of the oil droplets at the oil-water interface. Examples of suitable thickening agents are sulfonated polystyrene (water-dispersible, thickening grade), hydrophilic clays such as Bentonite, digested starch, natural gums, carboxy-substituted cellulose ethers, and the like. Often the Sickening agent is selected and employed in such quantities as to form a thixotropic gel in which are suspended the uniform-sized droplets of the oil. In other words, the thickened liquid generally should be non-Newtonian in its fluid behavior, i.e., of such a nature as to prevent rapid movement of the dispersed droplets within the aqueous liquid by the action of gravitational force due to the difference in density of the phases. The stress exerted on the surrounding medium by a suspended droplet is not sufficient to cause rapid movement of the droplet within such non-Newtonian media. Usually, the thickener agents are employed in such proportions relative to the aqueous liquid that the apparent viscosity of the thickened aqueous liquid is in the order of at least 500 centipoises (usually determined by means of a Brookfield viscosimeter using the No. 2 spindle at 30 rpm.). The thickening agent is preferably prepared as a separate concentrated aqueous composition that is then carefully blended with the oil droplet dispersion.

The resulting thickened dispersion is capable of being handled, e.g., passed through pipes, and can be subjected to polymerization conditions substantially without mechanical change in the size or shape of the dispersed oil droplets.

The resulting dispersions are particularly well suited for use in continuous polymerization procedures that can be carried out in coils, tubes, and elongated vessels adapted for continuously introducing the thickened dispersions into one end and for continuously withdrawing the mass of polymer beads from the other end. The polymerization step is also practiced in batch manner.

The order of the addition of the constituents to the polymerization usually is not critical, but beneficially it is more convenient to add to a vessel the water, dispersing agent, and incorporated the oil-soluble catalyst to the monomer mixture, and subsequently add with agitation the monomer phase to the water phase.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX (a colloidal suspension containing 50% silica sold by DuPont). A monomer phase is prepared by combining 3317 g styrene, 1421 g divinylbenzene (55% active cross-linking agent; other 45% is ethyl vinyl benzene which forms part of the styrene polymer chain) and 45 g VAZO 52 (a monomer-soluble initiator sold by DuPont). The mixture is passed through a homogenizer to obtain 5 $\mu$m droplets. The suspension is heated overnight at 52° C. to give 4.3 kg of generally spherical microbeads having an average diameter of about 5 $\mu$m with narrow size distribution (about 2–10 $\mu$m size distribution). The mol proportion of styrene and ethyl vinyl benzene to divinylbenzene is about 6.1%. The concentration of divinylbenzene can be adjusted up or down to result in about 2.5–50% (preferably 10–40%) cross-linking by the active cross-linker. Of course, monomers other than styrene and divinylbenzene can be used in similar suspension polymerization processes known in the art. Also, other initiators and promoters may be used as known in the art. Also, slip agents other than silica may also be used. For example, a number of LUDOX colloidal silicas are available from DuPont. LEPANDIN colloidal alumina is available from Degussa. NALCOAG colloidal silicas are available from Nalco, and tin oxide and titanium oxide are also available from Nalco.

Normally, for the polymer to have suitable physical properties such as resiliency, the polymer is cross-linked. In the case of styrene cross-linked with divinylbenzene, the polymer is 2.5–50% cross-linked, preferably 20–40% cross-linked. By percent cross-linked, it is meant the mol % of cross-linking agent based on the amount of primary monomer. Such limited cross-linking produces microbeads which are sufficiently coherent to remain intact during orientation of the continuous polymer. Beads of such cross-linking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, $\mu$m | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The microbeads of cross-linked polymer range in size from 0.1–50 $\mu$m, and are present in an amount of 30–50% by volume in the feed stock for the porous layer prior to extrusion and microvoiding. However, the preferred size range for this invention is 0.5–5 $\mu$m for best formation of an ink porous but smooth surface. Microbeads of polystyrene should have a Tg of at least 20° C. higher than the Tg of the continuous matrix polymer and must be hard compared to the continuous matrix polymer. When using polymerizable organic materials, elasticity and resiliency of the microbeads generally result in increased voiding, and it is preferred to have the Tg of the microbeads as high above that of the matrix polymer as possible to avoid deformation during orientation. It is not believed that there is a practical advantage to cross-linking above the point of resiliency and elasticity of the microbeads.

The microbeads at the top (permeable) layer are at least partially bordered by voids. The void space in the supports should occupy at least 40%, preferably 50–70%, by volume of the top layer for best ink absorption with a stable layer. At this level of voiding the voids have been shown to be interconnected or open-celled. Any less voiding results in a closed cell structure, which does not lend itself to capillary action and, thus, fast ink absorbency rate is not achievable. Depending on the manner in which the supports are made, the voids may completely encircle the microbeads, e.g., a void may be doughnut-shaped (or flattened doughnut) encircling a microbead, or the voids may only partially border the microbeads, e.g., a pair of voids may border a microbead on opposite sides.

During stretching the voids assume characteristic shapes from the balanced biaxial orientation of paperlike films to the uniaxial orientation of microvoided/satinlike fibers. Balanced microvoids are largely circular in the plane of orientation, while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The film supports according to this invention are prepared by:

(a) forming a mixture of molten continuous matrix polymer and microbeads uniformly dispersed throughout the matrix polymer, the matrix polymer being as described hereinbefore, the microbeads being as described hereinbefore, (b) forming a two-layered sheet from the mixture by coextrusion of material in (a) with a base polyester layer and casting said sheet on a chill roll, (c) orienting the cast sheet by stretching to form voids in the top layer at least partially bordering the microbeads on sides thereof in the direction, or directions of orientation.

The mixture may be formed by forming a melt of the matrix polymer and mixing therein the microbeads. When using microbeads of cross-linked polymer, it may be in the form of solid or semisolid microbeads. Due to the incompatibility between the matrix polymer and cross-linked polymer, there is no attraction or adhesion between them, and they become uniformly dispersed in the matrix polymer upon mixing.

After the microbeads are uniformly dispersed in the polymer matrix, the resin is used to form a layered film structure by the coextrusion process. Any one of the known techniques for coextruding cast polymer sheets can be employed. Such forming methods are well known in the art. Typical coextrusion technology is taught in W. J. Schrenk and T. Alfrey, Jr, "Coextruded Multilayer Polymer Films and Sheets," Chapter 15, Polymer Blends, p. 129–165, 1978, Academic Press; and D. Djorjevic, "Coextrusion," Vol. 6, No. 2, 1992 Rapra Review Reports. It is important that the cast, laminated sheet be subsequently oriented by stretching, at least in one direction. Methods of unilaterally or bilaterally orienting sheet or film material are well known in the art. Basically, such methods comprise stretching the sheet or film at least in the machine or longitudinal direction, after it is cast on a chill roll, by an amount of about 1.5–4.5 times its original dimension. Such sheet or film may also be stretched in the transverse or cross-machine direction by apparatus and methods well known in the art, in amounts of generally 1.5–4.5 times the original dimension. Stretching to these ratios is necessary to sufficiently void the top layer and to achieve desired levels of thickness uniformity and mechanical performance. Such apparatus and methods are well known in the art and are described, for example, in U.S. Pat. No. 3,903,234.

The voids of the top layer, or void spaces referred to herein, surrounding the microbeads are formed as the continuous matrix polymer is stretched at a temperature above its Tg. The microbeads are relatively hard under said temperature compared to the continuous matrix polymer. Also, due to the incompatibility between the microbead and the matrix polymer, the continuous matrix polymer slides over the microbeads as it is stretched, causing voids to be formed at the sides in the direction or directions of stretch, said voids elongate as the matrix polymer continues to be stretched. Thus, the final size and shape of the voids depend on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred stretching operation simultaneously opens the microvoids and orients the matrix material. The final product properties depend on and can be controlled by stretching time-temperature relationships and the type and degree of stretch. For maximum top layer porosity and texture, the stretching is done just above the glass transition temperature of the matrix polymer. If the glass transition temperature of the polymeric microbead is in the vicinity of the glass transition temperature of the matrix polymer, both phases would stretch together and porosity would decrease. If the beads are solid during the stretching step, the materials are pulled apart leading to the formation of voids at the interfacial regions between the phases.

In general, void formation in the top layer occurs independent of, and does not require, crystalline formation in the matrix polymer. Porous opaque, microvoided films have been made in accordance with the methods of this invention using completely amorphous, noncrystallizing copolyesters as the matrix phase. Crystallizable/orientable (strain hardening) matrix materials are preferred for some properties like tensile strength and gas transmission barrier. On the other hand, amorphous matrix materials have special utility in other areas like tear resistance and heat sealability. The specific matrix composition can be tailored to meet many product needs. The complete range from crystalline to amorphous matrix polymers can be used in the practice of this invention. A preferred embodiment of the invention comprises polyethylene terephthalate or its copolymers as the continuous phase polyester of the top permeable layer, as these materials are generally lower in cost and have desirable mechanical properties. It is common to subject the stretched film to high temperature after the stretching steps to improve dimensional stability and mechanical performance. This heat treatment step is known as heat setting. It should be noted though that if the top layer is amorphous, care should be taken during the conventional heat setting step to ensure that the voids formed during the stretching steps not be sealed through coalescence of the amorphous molten polymer. Indeed, in case that the glass transition temperature of the amorphous matrix polymer in the top layer is considerably lower than the heat setting temperature, the heat setting step must be altogether eliminated or the heat setting temperature must be lowered closer to the glass transition temperature of said polymer.

The base layer can also be voided. However, the loading, of the microbeads in this layer should be less than 25% by volume to assure closed pores and stretchability of the laminate. At this loading level a closed cell structure is formed as described heretofore, allowing the base layer to be biaxially oriented and providing support and mechanical integrity to the top permeable layer.

The base layer can be filled with pigments. This would enable improvement in optical properties such as opacity. Typical pigments are talc, calcium carbonate, clay, titanium dioxide, gypsum, and silica. $TiO_2$ is preferred for low cost and whiteness. The base layer can include tints and optical brighteners. This is commonly done to control whiteness of imaging support.

The support as heretofore described can be coated on the top layer with an ink receiving layer commonly used which contains mordanting agents to hold the ink dyes close to the top surface of the support, said ink receiving layer also containing UV absorbers and the like. Such layers are generally very thin and do not significantly reduce the absorbency rates of the support under said receiving layer.

Another embodiment of the invention is to laminate the heretofore described support to a paper on the base side of the support. In this embodiment the support heretofore described would comprise a thin base layer, as the paper would provide stiffness and a paper feel to the final laminated support.

In another embodiment of the invention a third permeable layer comprising the same materials as the heretofore described permeable layer is adjacent to the base layer on the opposite side of said first permeable layer. This layer could also be loaded to a level greater than 30% by volume and be ink permeable. It could be as thick as the top permeable layer to enable the same absorbing capacity or be thinner to lend a paper feel and have limited absorbing capacity. The final use of such a support would dictate the actual thickness of the film structure.

The following examples illustrate the practice of this invention. They are not intended to be exhaustive of all possible variations of the invention. Parts and percentages are by weight unless otherwise indicated.

EXAMPLES

Example 1

A two-layered film laminate comprising an impermeable base polyester layer and an absorbing top polyester layer is prepared in the following manner. The materials used in the preparation of the laminate are: 1) a poly(ethylene terephthalate) (PET) resin (IV=0.70 dl/g ) for the base layer; 2) a compounded blend consisting of 55% by weight PETG 6763 resin (IV=0.73 dl/g) (an amorphous polyester resin available from Eastman Chemical Company) and 45% by weight cross-linked spherical polystyrene beads 5 $\mu$m in dia. (Nom.) for the top layer. The beads were prepared by the limited coalescence method described heretofore. The beaded polystyrene was compounded with the PETG resin through mixing in a counter-rotating twin screw extruder attached to a pelletizing die. The resins were dried at 65° C. and fed by two plasticating screw extruders into a coextrusion die manifold to produce a two-layered melt stream which was rapidly quenched on a chill roll after issuing from the die. By regulating the throughputs of the extruders, it was possible to adjust the thickness ratio of the layers in the cast laminate sheet. In this case, the thickness ratio of the two layers was adjusted at 1:1 with the thickness of the absorbing layer being approx. 500 $\mu$m. The cast sheet was first oriented in the machine direction by stretching at a ratio of 3.3 and a temperature of 110° C.

The oriented sheet was then stretched in the transverse direction in a tenter frame at a ratio of 3.3 and a temperature of 100° C. In this example no heat setting treatment was applied. The final total film thickness was 100 $\mu$m with the permeable layer being 50 $\mu$m, and the layers within the film were fully integrated and strongly bonded. The stretching of the heterogeneous top layer created interconnected microvoids around the hard polystyrene beads, thus rendering this layer opaque (white) and highly porous and permeable. The PET base layer, however, was impermeable and retained its natural clarity. The stretched film was then cut to fit a HP 722 printer and printed using cyan, yellow, magenta, and black stripes printed utilizing the inks set forth above in the drying time test. The printed image was sharp, smudge-free without bleed and dye migration throughout the image, and the dry time was less than 1 second. The top layer had the feel of a paper surface. Dry time was measured by the method previously described.

Example 2 (Comparative)

Same as Example 1 except that the composition of the top layer comprised of 36% (wt) polystyrene beads (5 $\mu$m dia. nom.) and 64% of PETG. The dry time for this film was >5 min, and the image smudged on contact immediately after printing, indicating a low number of interconnected pores.

Example 3

Same as Example 1 except that the polystyrene beads had a nom. dia. of 2 $\mu$m. As in Example 1 we obtained sharp, smudge-free images with a dry time of less than 1 second.

Example 4

Same as Example 1 except that the particulate filler was calcium carbonate (Albacar 5970 obtained from Specialty Minerals Inc.) with an average particle size of 1.9 $\mu$m. Here, too, the film was white in appearance, and the printed images were sharp and smudge-free with a dry time of less than 1 second.

Example 5 (Comparative)

Same as Example 1 except that the thickness of the absorbing layer was reduced to 28 $\mu$m. In this case the printed image suffered from severe bleed and the dry time was approx. 5 min, indicating the layer was too thin to absorb all of the printed ink.

The invention has been described in detail with particular reference to certain preferred embodiments thereof, but it will be understood that variations and modifications can be effected within the spirit and scope of the invention.

What is claimed is:

1. An imaging support comprising a base polyester layer and an ink permeable upper polyester layer, said upper layer comprised of a continuous polyester phase having an ink absorbency rate resulting in a dry time of less than 10 seconds and a total absorbent capacity of at least 14.0 cc/$m^2$ wherein said base is selected such that the imaging support has a thickness of between 50 and 500 micrometer, and wherein said upper polyester layer is voided, has a glass transition temperature between 50° C. and 150° C., is stretchable, and has an inherent viscosity of at least 0.5 dl/g.

2. The imaging support of claim 1 wherein said base layer is substantially impermeable.

3. The imaging support of claim 1 wherein said base layer comprises a voiding agent to an extent less than 25% by volume and is substantially impermeable.

4. The imaging support of claim 3 wherein void agents in said base layer consist of at least one member selected from the group consisting of teflon, silica, alumina, barium sulfate, calcium carbonate, polystyrene, polycarbonates, polyolefins or other polymers immiscible with the base layer.

5. The imaging support of claim 1 wherein said base layer and said upper layer comprise an integral member.

6. The imaging support of claim 5 wherein said permeable layer comprises voids present in an amount between 30 and 50 percent by volume of said permeable layer.

7. The imaging support of claim 6 wherein said base layer contains pigments.

8. The imaging support of claim 7 wherein said pigments consist of at least one member selected from the group consisting of talc, calcium carbonate, clay, titanium dioxide, gypsum, and silica.

9. The imaging support of claim 7 wherein said ink permeable polyester layer comprises amorphous polyester.

10. The imaging support of claim 1 wherein said permeable upper layer comprises a voiding agent.

11. The imaging support of claim 1 wherein said permeable upper layer has an absorbent capacity of at least 30.0 $cc/m^2$.

12. The imaging support of claim 1 wherein said permeable upper layer comprises a voiding agent to an extent greater than 30% by volume.

13. The imaging support of claim 1 wherein said base layer comprises polyethylene terephthalate.

14. The imaging support of claim 1 wherein said continuous phase polyester of said permeable upper layer comprises polyethylene terephthalate, polyethylene-1,4-cyclohexylenedimethylene terephthalate, or blends thereof.

15. The imaging support of claim 1 wherein the voiding agents in said permeable layer consist of at least one member selected from the group consisting of fluoropolymers, silica, alumina, barium sulfate, calcium carbonate, polystyrene, polycarbonates, and polyolefins.

16. The imaging support of claim 15 wherein said voiding agents are between 0.01 and 10.0 $\mu$m in size.

17. The imaging support of claim 1 wherein voiding agents in said permeable layer comprise cross linked polystyrene beads.

18. The imaging support of claim 1 wherein said base layer contains tints or optical brighteners.

19. The imaging member of claim 1 wherein the voiding agents for the permeable layer comprises polymers immiscible with the upper polyester layer.

20. The imaging support of claim 1 wherein said permeable upper layer has an ink absorbency rate resulting in a dry time of less than 1 second.

21. The imaging member of claim 1 further comprising a lower permeable layer adjacent to said base layer on the opposite side from said first permeable layer.

22. The imaging support of claim 20 wherein said lower permeable layer comprises a voiding agent and is ink permeable.

23. The imaging support of claim 1 wherein said support has a thickness between 50 and 250 $\mu$m.

24. The imaging support of claim 1 further comprising paper laminated to the lower side of said base polyester layer.

* * * * *

UNITED STATES PATENT AND TRADEMARK OFFICE

CERTIFICATE OF CORRECTION

PATENT NO. : 6,379,780 B1 
DATED : April 30, 2002
INVENTOR(S) : Thomas M. Laney et al.

It is certified that error appears in the above-identified patent and that said Letters Patent is hereby corrected as shown below:

Column 16,
Line 26, "claim 20" change to -- claim 21 --

Signed and Sealed this

Tenth Day of December, 2002

JAMES E. ROGAN
*Director of the United States Patent and Trademark Office*